US010005293B2

(12) United States Patent
Nishida

(10) Patent No.: US 10,005,293 B2
(45) Date of Patent: Jun. 26, 2018

(54) PRINTING APPARATUS, CONTROL METHOD THEREFOR AND STORAGE MEDIUM

(71) Applicant: CANON KABUSHIKI KAISHA, Tokyo (JP)

(72) Inventor: Tomofumi Nishida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/247,764

(22) Filed: Aug. 25, 2016

(65) Prior Publication Data

US 2017/0066261 A1 Mar. 9, 2017

(30) Foreign Application Priority Data

Sep. 9, 2015 (JP) ..... 2015-177920

(51) Int. Cl.
*B41J 29/38* (2006.01)
*B41J 3/60* (2006.01)
(Continued)

(52) U.S. Cl.
CPC ..... *B41J 3/60* (2013.01); *B41J 13/0018* (2013.01); *B65H 5/24* (2013.01); *B65H 5/062* (2013.01); *B65H 7/02* (2013.01); *B65H 85/00* (2013.01); *B65H 2301/3331* (2013.01); *B65H 2301/51212* (2013.01); *B65H 2404/612* (2013.01);
(Continued)

(58) Field of Classification Search
None
See application file for complete search history.

(56) References Cited

U.S. PATENT DOCUMENTS 3,456,951 A * 7/1969 Rhoades ..... G11B 5/004 360/240
5,974,298 A 10/1999 Urban et al.
(Continued)

FOREIGN PATENT DOCUMENTS

CN 101875264 A 11/2010
CN 101898698 A 12/2010
(Continued)

OTHER PUBLICATIONS

U.S. Appl. No. 15/247,760, filed Aug. 25, 2016. Inventor: Tomofumi Nishida.
(Continued)

*Primary Examiner* — Matthew Luu
*Assistant Examiner* — Tracey McMillion
(74) *Attorney, Agent, or Firm* — Fitzpatrick, Cella, Harper & Scinto

(57) ABSTRACT

A printing apparatus includes a feeding roller to feed a sheet, a conveyance roller conveys the sheet, a printing head prints on the sheet, a reversing path that reverses the sheet from a first surface to a second surface, and a control unit that controls feeding of a preceding sheet and a succeeding sheet fed next to the preceding sheet. The control unit starts feeding of the succeeding sheet when a trailing edge of the preceding sheet, which was reversed by the reversing path, reaches a predetermined position and feeds the succeeding sheet so that a distance between the trailing edge of the preceding sheet and a leading edge of the succeeding sheet is within a predetermined range.

14 Claims, 14 Drawing Sheets

(51) Int. Cl.

| | |
|---|---|
| ***B41J 13/00*** | (2006.01) |
| ***B65H 5/24*** | (2006.01) |
| *B65H 85/00* | (2006.01) |
| *B65H 5/06* | (2006.01) |
| *B65H 7/02* | (2006.01) |

(52) U.S. Cl.
CPC ..... *B65H 2511/11* (2013.01); *B65H 2513/10* (2013.01); *B65H 2513/53* (2013.01); *B65H 2701/1311* (2013.01); *B65H 2801/12* (2013.01)

(56) References Cited

U.S. PATENT DOCUMENTS

| | | | | |
|---|---|---|---|---|
| 6,470,169 | B2 | 10/2002 | Nakazato | |
| 8,899,572 | B2 * | 12/2014 | Gotoda | B65H 5/26 271/258.01 |
| 9,284,145 | B2 | 3/2016 | Gotoda | |
| 2004/0251589 | A1 * | 12/2004 | Satoh | B65H 5/062 271/10.01 |
| 2006/0072138 | A1 * | 4/2006 | Nakanishi | B41J 3/60 358/1.12 |
| 2010/0278578 | A1 * | 11/2010 | Yamada | B41J 3/60 400/582 |
| 2010/0302298 | A1 * | 12/2010 | Moriyama | B41J 3/60 347/16 |
| 2011/0024965 | A1 * | 2/2011 | Tokoro | B41J 3/60 271/3.14 |
| 2016/0052308 | A1 | 2/2016 | Sahara et al. | |

FOREIGN PATENT DOCUMENTS

| | | | |
|---|---|---|---|
| CN | 103522764 | A | 1/2014 |
| JP | 2000-15881 | A | 1/2000 |
| JP | 2001-270645 | A | 10/2001 |

OTHER PUBLICATIONS

Office Action dated Oct. 10, 2017, issued in Chinese Application No. 201610800818.0.

* cited by examiner

PRINTING APPARATUS, CONTROL METHOD THEREFOR AND STORAGE MEDIUM

BACKGROUND OF THE INVENTION

Field of the Invention

The present invention relates to a printing apparatus which prints a sheet by a printhead. More specifically, the present invention relates to a printing apparatus which, when printing on both sides of a printing sheet, feeds sheets while narrowing the distance between a preceding sheet and a succeeding sheet, and shortens a time between completing a printing operation for the preceding sheet and starting a printing operation for the succeeding sheet.

Description of the Related Art

Japanese Patent Laid-Open No. 2000-15881 describes a printing apparatus for controlling to make the marginal area of the leading edge of a succeeding sheet overlap the marginal area of the trailing edge of a preceding sheet, which comprises a feeding means for separating and feeding a plurality of sheets one by one, a printing means for forming an image on a sheet, a conveyance means for conveying a sheet to the printing means, a detection means for detecting a sheet, and a control means for controlling driving of the feeding means according to a signal of the detection means.

However, the apparatus described in Japanese Patent Laid-Open No. 2000-15881 can start to feed a succeeding sheet only when the marginal amount of the trailing edge of the preceding sheet and the marginal amount of the leading edge of the succeeding sheet are confirmed before the start of feeding of the succeeding sheet. This imposes a technical problem that it takes time to start to feed the succeeding sheet.

When printing on the both sides of the printing sheet, there is also a technical problem that how to start feeding the succeeding sheet is not clear.

SUMMARY OF THE INVENTION

The present invention has been made in consideration of the above-described problem, and provides a printing apparatus which can start to feed a succeeding sheet even if the marginal amount of the trailing edge of a preceding sheet and the marginal amount of the leading edge of the succeeding sheet are not confirmed when printing on both sides of a printing sheet.

According to a first aspect of the present invention, there is provided a printing apparatus comprising: a feeding roller configured to feed a sheet; a conveyance roller configured to convey the sheet fed by the feeding roller; a printing unit configured to print the sheet conveyed by the conveyance roller; and a control unit configured to, when performing a printing operation on both sides of the sheet, start to feed a succeeding sheet before the printing operation on a back surface of a preceding sheet is complete, and maintaining a distance between a trailing edge of the preceding sheet and a leading edge of the succeeding sheet at a substantially constant distance after feeding of the succeeding sheet starts.

According to a second aspect of the present invention, there is provided a control method of a printing apparatus including a feeding roller configured to feed a sheet, a conveyance roller configured to convey the sheet fed by the feeding roller, and a printing unit configured to print the sheet conveyed by the conveyance roller, the method comprising: when performing a printing operation on both sides of the sheet, starting to feed a succeeding sheet before the printing operation on a back surface of a preceding sheet is complete; and maintaining a distance between a trailing edge of the preceding sheet and a leading edge of the succeeding sheet at a substantially constant distance after feeding of the succeeding sheet starts.

Further features of the present invention will become apparent from the following description of exemplary embodiments with reference to the attached drawings.

DESCRIPTION OF THE EMBODIMENTS

An embodiment of the present invention will be described in detail below with reference to the accompanying drawings.

Figure 1:
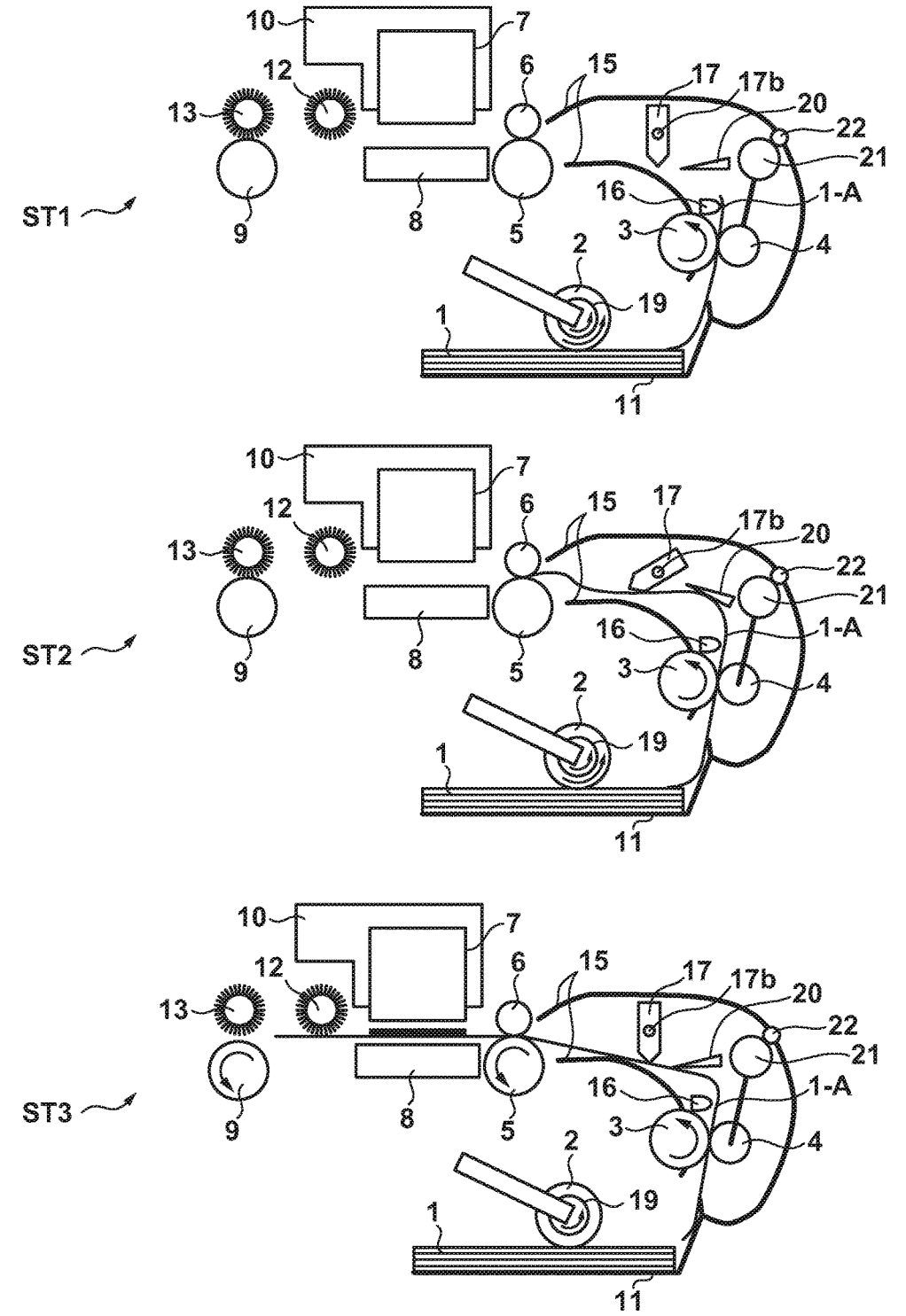
FIG. 1 shows views for explaining a feeding operation when performing a printing operation on one side of a sheet in a printing apparatus according to an embodiment of the present invention.
Figure 2:
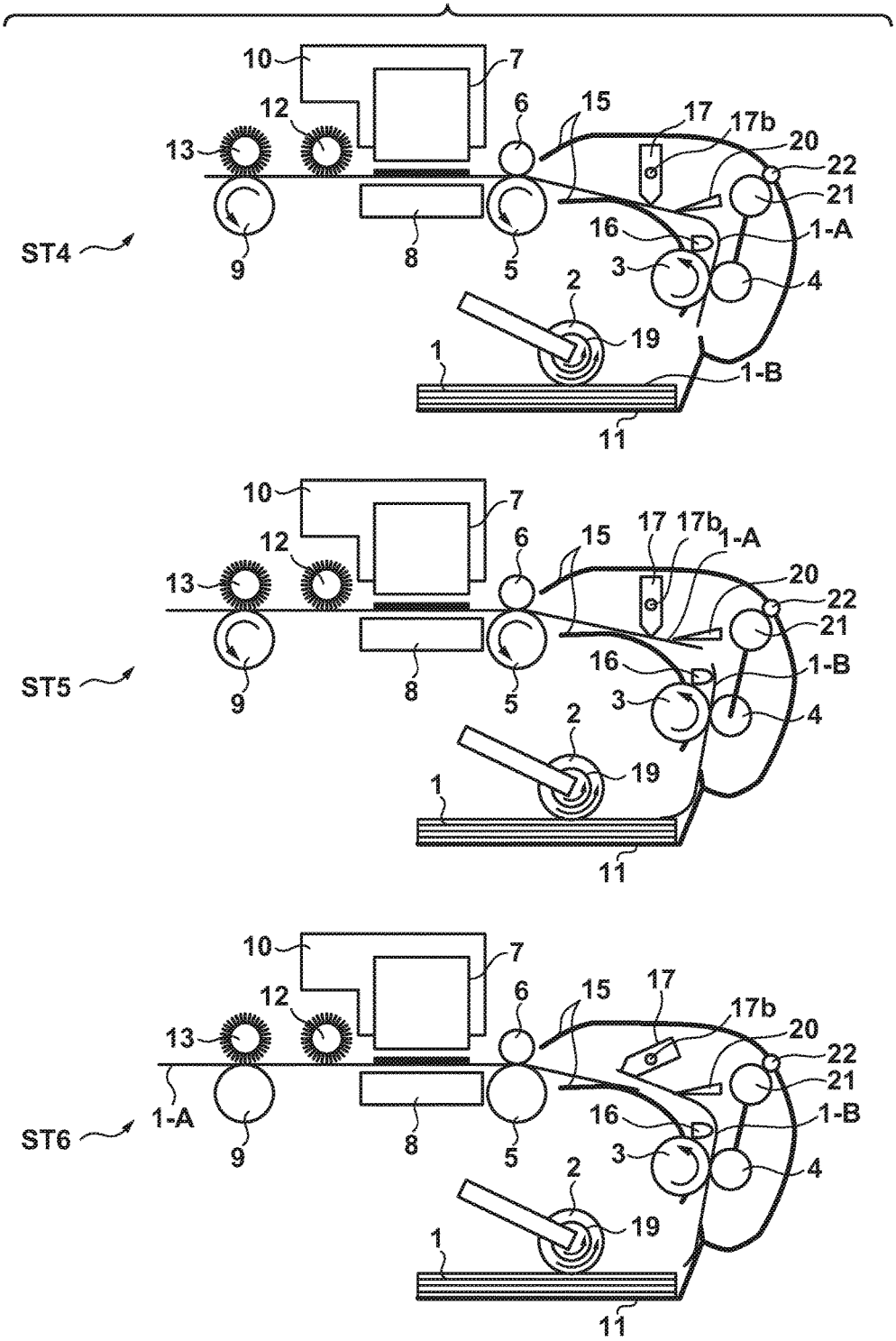
FIG. 2 shows views for explaining the feeding operation when performing the printing operation on one side of the sheet in the printing apparatus according to the embodiment of the present invention.
Figure 3:
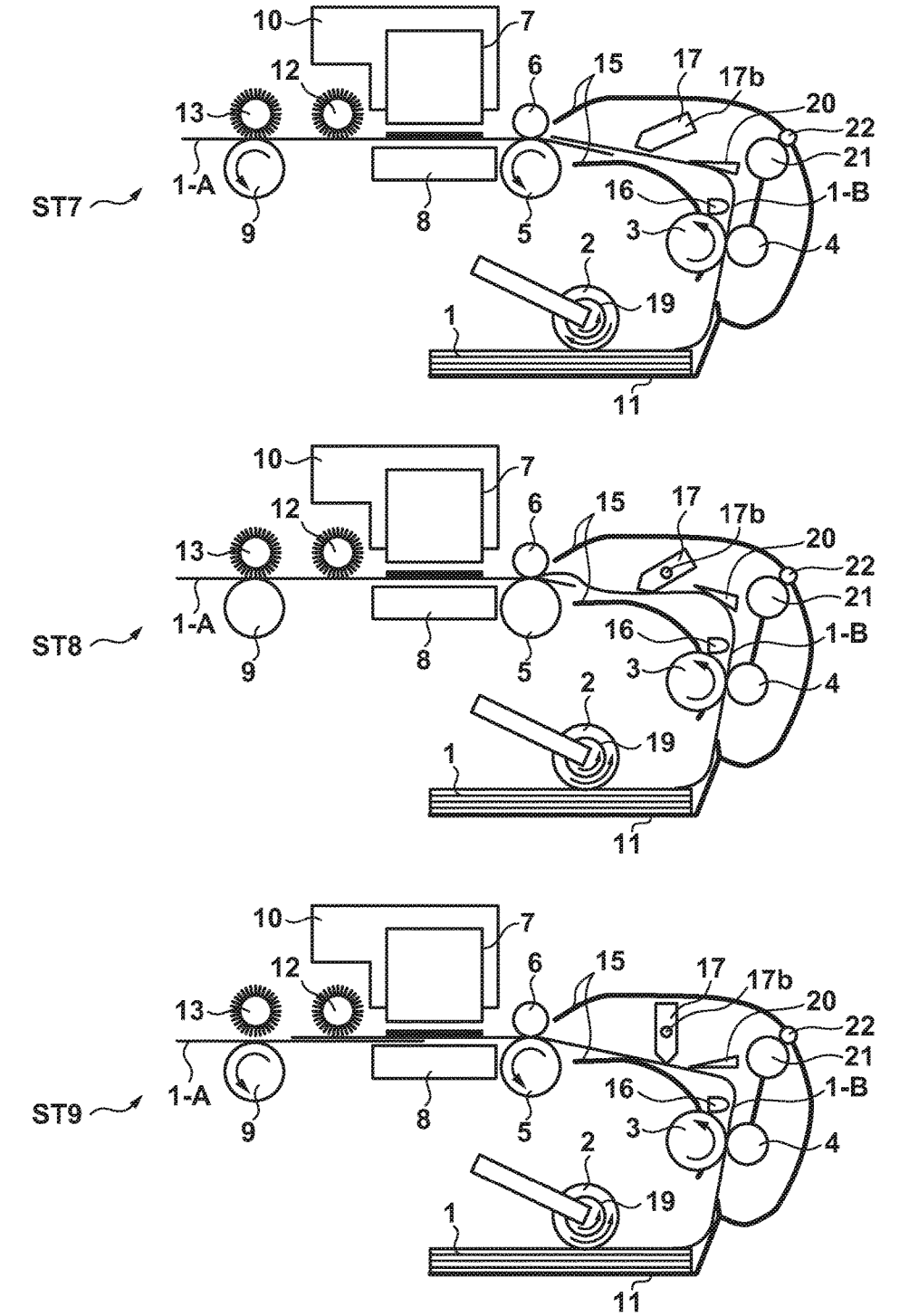
FIG. 3 shows views for explaining the feeding operation when performing the printing operation on one side of the sheet in the printing apparatus according to the embodiment of the present invention.

FIGS. 1 to 3 are sectional views for explaining a feeding operation when printing on one side of a printing sheet in a printing apparatus capable of printing on both sides of the printing sheet according to an embodiment of the present invention. The schematic arrangement of the printing apparatus according to the embodiment will first be described with reference to ST1 of FIG. 1.

In ST1 of FIG. 1, reference numeral 1 denotes printing sheets. The plurality of printing sheets 1 are stacked on a feeding tray 11 (a stacking unit). A pickup roller 2 abuts against the top printing sheet 1 stacked on the feeding tray 11 to pick it up. A feeding roller 3 feeds the printing sheet 1 picked up by the pickup roller 2 toward the downstream side of a sheet conveyance direction. A feeding driven roller 4 is biased against the feeding roller 3 to sandwich the printing sheet 1 with the feeding roller 3, thereby feeding the printing sheet 1.

A conveyance roller 5 conveys the printing sheet 1 fed by the feeding roller 3 and the feeding driven roller 4 to a position facing a printhead 7. A pinch roller 6 is biased against the conveyance roller 5 to sandwich the printing sheet with the conveyance roller 5, thereby conveying the printing sheet.

The printhead 7 prints the printing sheet 1 conveyed by the conveyance roller 5 and the pinch roller 6. In this embodiment, an inkjet printhead which prints the printing sheet 1 by discharging ink from the printhead will be exemplified. A platen 8 supports the back surface of the printing sheet 1 at the position facing the printhead 7. A carriage 10 mounts the printhead 7 and moves in a direction intersecting the sheet conveyance direction.

A discharge roller 9 discharges the printing sheet printed by the printhead 7 to the outside of the apparatus. Spurs 12 and 13 rotate while they are in contact with the printing surface of the printing sheet printed by the printhead 7. The spur 13 on the downstream side is biased against the discharge roller 9, and no discharge roller 9 is arranged at a position facing the spur 12 on the upstream side. The spur 12 is used to prevent the floating of the printing sheet 1, and is also referred to as a pressing spur.

Conveyance guides 15 guide the printing sheet 1 between a feeding nip portion formed by the feeding roller 3 and the feeding driven roller 4 and a conveyance nip portion formed by the conveyance roller 5 and the pinch roller 6. A sheet detection sensor 16 detects the leading edge and the trailing edge of the printing sheet 1. The sheet detection sensor 16 is provided downstream of the feeding roller 3 in the sheet conveyance direction. A sheet pressing lever 17 is biased by a spring around a rotating shaft 17*b* in a counterclockwise direction in FIG. 1.

Reference numeral 21 denotes a reverse roller. Reference numeral 22 denotes a reverse driven roller. The conveyance roller 5 and the pinch roller 6 are reversely rotated, thereby reversely conveying the printing sheet 1 to a reverse feeding nip portion formed by the reverse roller 21 and the reverse driven roller 22. Then, the reverse roller 21 and the reverse driven roller 22 re-feed the printing sheet 1 to the feeding nip portion formed by the feeding roller 3 and the feeding driven roller 4, reversing the printing sheet 1.

A flapper 20 guides the printing sheet 1. The flapper 20 is raised by the printing sheet 1 when the feeding roller 3 and the feeding driven roller 4 feed the printing sheet 1 to the conveyance nip portion, thereby securing a conveyance path from the feeding nip portion and the conveyance nip portion. In a situation other than this, the flapper 20 is lowered by its own weight, thereby securing a conveyance path from the conveyance nip portion to the reverse feeding nip portion.

Figure 4A:
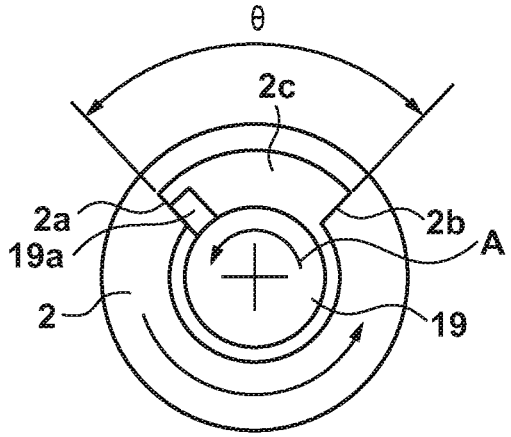
FIGS. 4A and 4B are views for explaining the arrangement of a pickup roller.
Figure 4B:
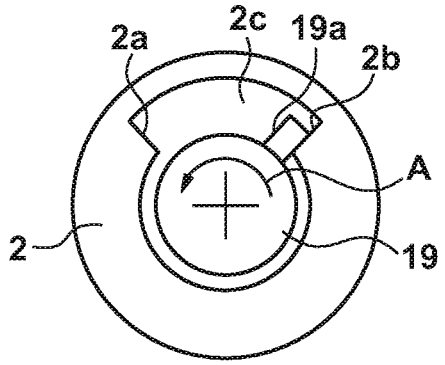

FIGS. 4A and 4B are views for explaining the arrangement of the pickup roller 2. As described above, the pickup roller 2 abuts against the top printing sheet stacked on the feeding tray 11 to pick it up. A driving shaft 19 transmits driving of a feeding motor (to be described later) to the pickup roller 2. When picking up the printing sheet, the driving shaft 19 and the pickup roller 2 rotate in a direction indicated by an arrow A in FIGS. 4A and 4B. A projection 19*a* is formed in the driving shaft 19. A concave portion 2*c* in which the projection 19*a* fits is formed in the pickup roller 2. As shown in FIG. 4A, when the projection 19*a* abuts against a first surface 2*a* of the concave portion 2*c* of the pickup roller 2, driving of the driving shaft 19 is transmitted to the pickup roller 2. In this case, when the driving shaft 19 is driven, the pickup roller 2 is also rotated. On the other hand, as shown in FIG. 4B, when the projection 19*a* abuts against a second surface 2*b* of the concave portion 2*c* of the pickup roller 2, driving of the driving shaft 19 is not transmitted to the pickup roller 2. In this case, even if the driving shaft 19 is driven, the pickup roller 2 is not rotated. Also, when the projection 19*a* is formed between the first surface 2*a* and the second surface 2*b* without abutting against the first surface 2*a* or the second surface 2*b*, even if the driving shaft 19 is driven, the pickup roller 2 is not rotated.

Figure 5:
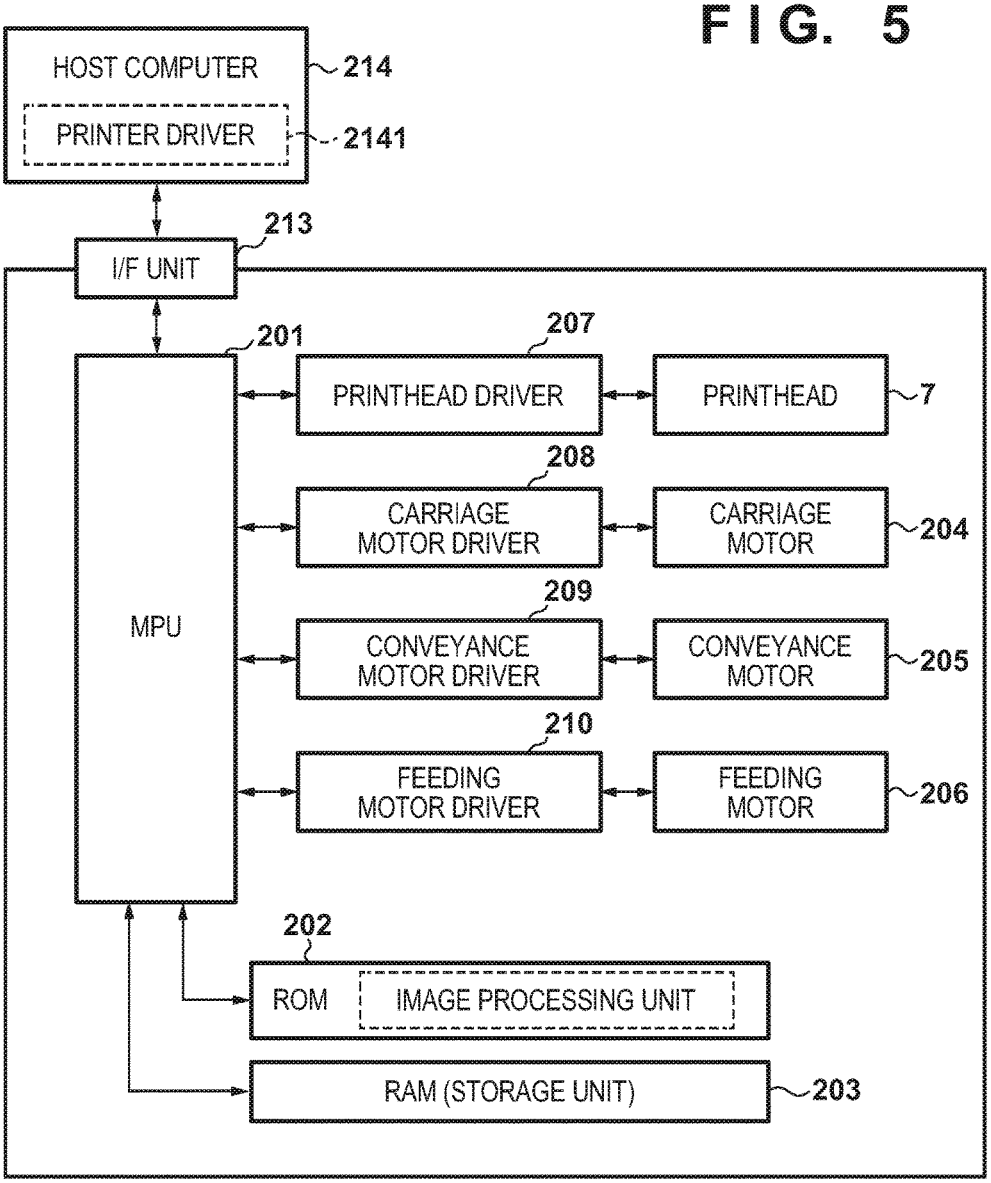
FIG. 5 is a block diagram showing the printing apparatus according to the embodiment.

FIG. 5 is a block diagram showing the printing apparatus according to this embodiment. An MPU 201 controls the operation of each unit, data processing, and the like. The MPU 201 also functions as a conveyance control means capable of controlling conveyance of the printing sheets. A ROM 202 stores data and programs to be executed by the MPU 201. A RAM 203 temporarily stores processing data to be executed by the MPU 201 and data received from a host computer 214.

A printhead driver 207 controls the printhead 7. A carriage motor driver 208 controls a carriage motor 204 for driving the carriage 10. A conveyance motor 205 drives the conveyance roller 5 and the discharge roller 9. A conveyance motor driver 209 controls the conveyance motor 205. A feeding motor 206 drives the pickup roller 2, feeding roller 3, and the reverse roller 21. A feeding motor driver 210 controls the feeding motor 206.

In the host computer 214, a printer driver 2141 is used to communicate with the printing apparatus by collecting printing information such as a printing image and printing image quality when the user instructs the execution of a printing operation. The MPU 201 exchanges the printing image and the like with the host computer 214 via an I/F unit 213.

The main purpose of this embodiment is an operation of printing on both sides of the printing sheet 1. Before the description thereof, however, a case will be described in which printing is performed on one side of the printing sheet 1. FIGS. 1 to 3 are sectional views for explaining an overlap continuous feeding operation in one-sided printing according to this embodiment. Overlap continuous feeding means an operation of conveying the printing sheets by making the leading edge of the succeeding sheet overlap the trailing edge of the preceding sheet and shortening the conveyance/feeding time of the printing sheets.

The overlap continuous feeding operation will be described in time series with reference to ST1 of FIG. 1 to ST9 of FIG. 3. When the host computer 214 transmits printing data via the I/F unit 213, the printing data is processed by the MPU 201, and then loaded into the RAM 203. The MPU 201 starts a printing operation based on the loaded data.

The description will be given with reference to ST1 of FIG. 1. At the beginning, the feeding motor driver 210 drives the feeding motor 206 at low speed. This rotates the pickup roller 2 (first feeding roller) at 7.6 inches/sec. When the pickup roller 2 rotates, the top printing sheet (a preceding sheet 1-A) stacked on the feeding tray 11 is picked up. The preceding sheet 1-A picked up by the pickup roller 2 is conveyed by the feeding roller 3 (a second feeding roller) rotating in the same direction as that of the pickup roller 2. The feeding motor 206 also drives the feeding roller 3.

When the sheet detection sensor 16 provided on the downstream side of the feeding roller 3 detects the leading edge of the preceding sheet 1-A, the feeding motor 206 is switched to high-speed driving. That is, the pickup roller 2 and the feeding roller 3 rotate at 20 inches/sec.

The description will be given with reference to ST2 of FIG. 1. By continuously rotating the feeding roller 3, the leading edge of the preceding sheet 1-A rotates the sheet pressing lever 17 about the rotating shaft 17*b* in the clockwise direction against the biasing force of the spring. When the feeding roller 3 is further continuously rotated, the leading edge of the preceding sheet 1-A abuts against the conveyance nip portion formed by the conveyance roller 5 and the pinch roller 6. At this time, the conveyance roller 5 stops. By rotating the feeding roller 3 by a predetermined amount even after the leading edge of the preceding sheet 1-A abuts against the conveyance nip portion, alignment of the preceding sheet 1-A is performed to correct the skew while the leading edge of the preceding sheet 1-A abuts against the conveyance nip portion. The skew correction operation will also be referred to as a registration adjustment operation.

The description will be given with reference to ST3 of FIG. 1. Upon end of the skew correction operation of the preceding sheet 1-A, the conveyance motor 205 is driven to start rotation of the conveyance roller 5. The conveyance roller 5 conveys the preceding sheet 1-A at 15 inches/sec. After the preceding sheet 1-A is aligned with the position facing the printhead 7, a printing operation is performed by discharging ink from the printhead 7 based on the printing data. Note that the alignment operation is performed by making the leading edge of the printing sheet abut against the conveyance nip portion to temporarily position the printing sheet at the position of the conveyance roller 5, and then controlling the rotation amount of the conveyance roller 5 with reference to the position of the conveyance roller 5.

The printing apparatus of this embodiment is a serial type printing apparatus in which the carriage 10 mounts the printhead 7. An operation of printing the printing sheet is performed by repeating a conveyance operation of intermittently conveying the printing sheet by a predetermined amount using the conveyance roller 5 and an image forming operation of discharging ink from the printhead 7 while moving the carriage 10 incorporating the printhead 7 when the conveyance roller 5 stops.

When alignment of the preceding sheet 1-A is performed, the feeding motor 206 is switched to low-speed driving. That is, the pickup roller 2 and the feeding roller 3 rotate at 7.6 inches/sec. While the conveyance roller 5 intermittently conveys the printing sheet by the predetermined amount, the feeding motor 206 also intermittently drives the feeding roller 3. That is, while the conveyance roller 5 rotates, the feeding roller 3 also rotates. While the conveyance roller 5 stops, the feeding roller 3 also stops. The rotation speed of the feeding roller 3 is lower than that of the conveyance roller 5. Consequently, the sheet is stretched between the conveyance roller 5 and the feeding roller 3. The feeding roller 3 is rotated together with the printing sheet conveyed by the conveyance roller 5.

Since the feeding motor 206 is intermittently driven, the driving shaft 19 is also driven. As described above, the rotation speed of the pickup roller 2 is lower than that of the conveyance roller 5. Consequently, the pickup roller 2 is rotated together with the printing sheet conveyed by the conveyance roller 5. That is, the pickup roller 2 rotates ahead of the driving shaft 19. More specifically, the projection 19*a* of the driving shaft 19 is spaced apart from the first surface 2*a* and abuts against the second surface 2*b*. Therefore, the second printing sheet (a succeeding sheet 1-B) is not picked up soon after the trailing edge of the preceding sheet 1-A passes through the pickup roller 2. After the driving shaft 19 is driven for a predetermined time, the projection 19*a* abuts against the first surface 2*a* and the pickup roller 2 starts to rotate.

The description will be given with reference to ST4 of FIG. 2. A state in which the pickup roller 2 starts to rotate, and picks up the succeeding sheet 1-B is shown. Due to a factor such as the responsiveness of the sensor, the sheet detection sensor 16 requires a predetermined distance or more between the printing sheets to detect the edges of the printing sheets. That is, it is necessary to separate the leading edge of the succeeding sheet 1-B from the trailing edge of the preceding sheet 1-A by a predetermined distance to provide a predetermined time interval from when the sheet detection sensor 16 detects the trailing edge of the preceding sheet 1-A until it detects the leading edge of the succeeding sheet 1-B. To achieve this, the angle of the concave portion 2*c* of the pickup roller 2 is set to about 70°.

The description will be given with reference to ST5 of FIG. 2. The succeeding sheet 1-B picked up by the pickup roller 2 is conveyed by the feeding roller 3. At this time, the preceding sheet 1-A undergoes an image forming operation by the printhead 7 based on the printing data. When the sheet detection sensor 16 detects the leading edge of the succeeding sheet 1-B, the feeding motor 206 is switched to high-speed driving. That is, the pickup roller 2 and the feeding roller 3 rotate at 20 inches/sec.

The description will be given with reference to ST6 of FIG. 2. The sheet pressing lever 17 presses the trailing edge of the preceding sheet 1-A downward, as shown in ST5 of FIG. 2. It is possible to form a state in which the leading edge of the succeeding sheet 1-B overlaps the trailing edge of the preceding sheet 1-A by moving the succeeding sheet 1-B at a speed higher than that at which the preceding sheet 1-A moves downstream by the printing operation of the printhead 7 (ST6 of FIG. 2). Since the preceding sheet 1-A undergoes the printing operation based on the printing data, it is intermittently conveyed by the conveyance roller 5. On the other hand, after the sheet detection sensor 16 detects the leading edge of the succeeding sheet 1-B, the succeeding sheet 1-B can catch up with the preceding sheet 1-A by continuously rotating the feeding roller 3 at 20 inches/sec.

The description will be given with reference to ST7 of FIG. 3. After forming an overlap state in which the leading edge of the succeeding sheet 1-B overlaps the trailing edge of the preceding sheet 1-A, the succeeding sheet 1-B is conveyed by the feeding roller 3 until the leading edge of the succeeding sheet 1-B stops at a predetermined position upstream of the conveyance nip portion. The position of the leading edge of the succeeding sheet 1-B is calculated from the rotation amount of the feeding roller 3 after the sheet detection sensor 16 detects the leading edge of the succeeding sheet 1-B, and controlled based on the calculation result. At this time, the preceding sheet 1-A undergoes an image forming operation based on the printing data by the printhead 7.

The description will be given with reference to ST8 of FIG. 3. When the conveyance roller 5 stops to perform the image forming operation (ink discharge operation) of the last row of the preceding sheet 1-A, the feeding roller 3 is driven to make the leading edge of the succeeding sheet 1-B abut against the conveyance nip portion, thereby performing the skew correction operation of the succeeding sheet 1-B.

The description will be given with reference to ST9 of FIG. 3. When the image forming operation of the last row of the preceding sheet 1-A ends, it is possible to perform alignment of the succeeding sheet 1-B while keeping the state in which the succeeding sheet 1-B overlaps the preceding sheet 1-A by rotating the conveyance roller 5 by a predetermined amount. The succeeding sheet 1-B undergoes a printing operation by the printhead 7 based on the printing data. When the succeeding sheet 1-B is intermittently conveyed for the printing operation, the preceding sheet 1-A is also intermittently conveyed, and is finally discharged outside the printing apparatus by the discharge roller 9.

When alignment of the succeeding sheet 1-B is performed, the feeding motor 206 is switched to low-speed driving. That is, the pickup roller 2 and the feeding roller 3 rotate at 7.6 inches/sec. If there is printing data even after the succeeding sheet 1-B, the process returns to ST4 of FIG. 2 to pick up the third printing sheet.

The sequence of the overlap continuous feeding operation of conveying the printing sheets by making the leading edge of the succeeding sheet overlap the trailing edge of the preceding sheet when printing on one side of the printing sheet 1 has been described above.

FIGS. 6 to 10 are sectional views for explaining the feeding operation when printing on both sides of the printing sheet in the printing apparatus according to this embodiment. The feeding operation of the preceding sheet and the succeeding sheet when printing on both sides of the printing sheet will be described in time series with reference to ST11 of FIG. 6 to ST23 of FIG. 10. When the host computer 214 transmits printing data on the front surface via the I/F unit 213, the printing data is processed by the MPU 201, and then loaded into the RAM 203. The MPU 201 starts a printing operation based on the loaded data.

Figure 6:
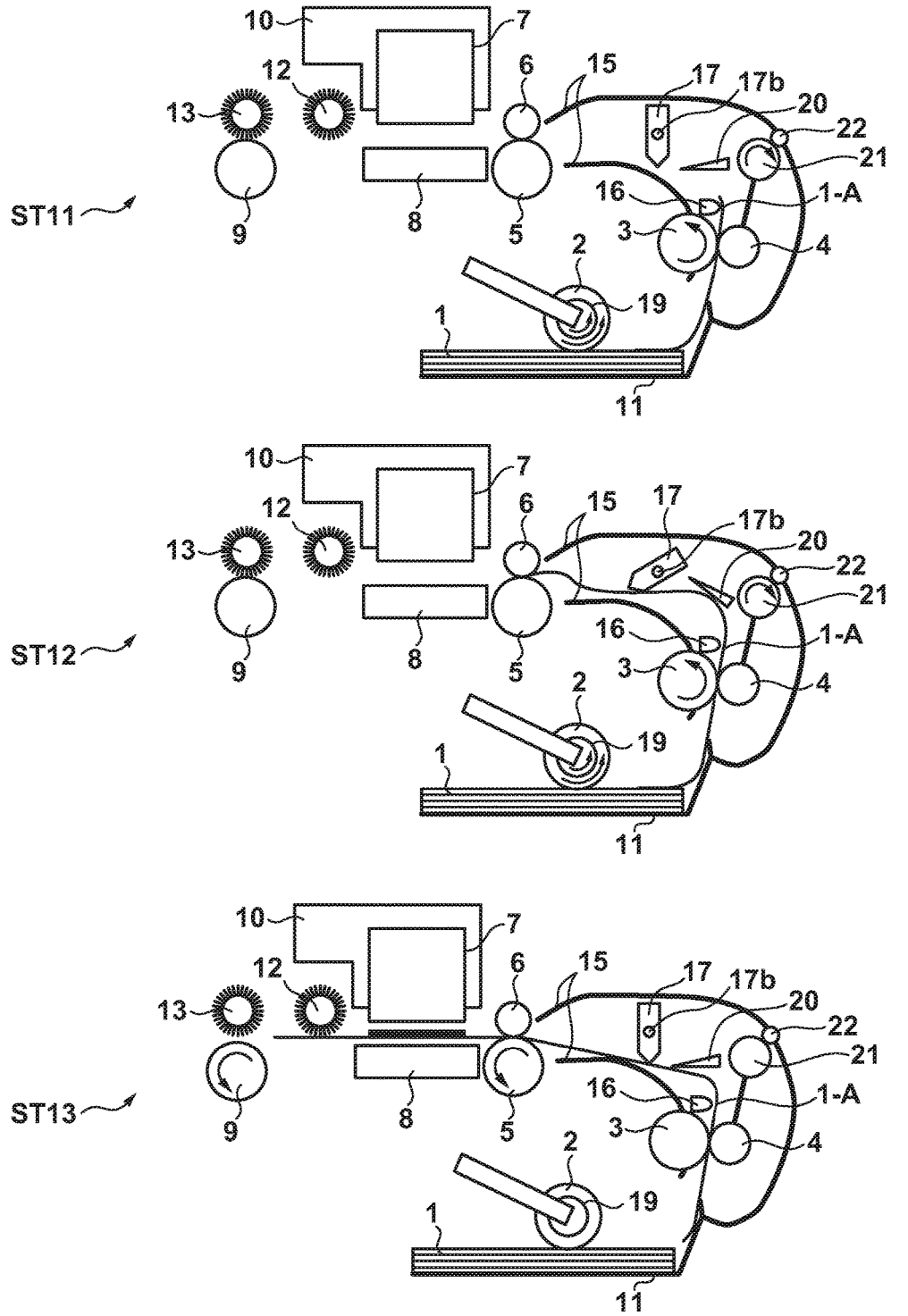
FIG. 6 shows views for explaining the feeding operation when performing the printing operation on both sides of the sheet in the printing apparatus according to the embodiment of the present invention.

The description will be given with reference to ST11 of FIG. 6. At the beginning, the feeding motor driver 210 drives the feeding motor 206. This rotates the pickup roller 2. When the pickup roller 2 rotates, the top printing sheet (the preceding sheet 1-A) stacked on the feeding tray 11 is picked up. The preceding sheet 1-A picked up by the pickup roller 2 is conveyed by the feeding roller 3 rotating in the same direction as that of the pickup roller 2. The feeding motor 206 also drives the feeding roller 3. This embodiment will be described by using an arrangement including the pickup roller 2 and the feeding roller 3. However, an arrangement including only a feeding roller for feeding the printing sheet stacked on the stacking unit may be adopted. The sheet detection sensor 16 provided on the downstream side of the feeding roller 3 detects the leading edge of the preceding sheet 1-A.

The description will be given with reference to ST12 of FIG. 6. By continuously rotating the feeding roller 3, the leading edge of the preceding sheet 1-A pushes the flapper 20 upward to move downstream, and then rotates the sheet pressing lever 17 about the rotating shaft 17*b* in the clockwise direction against the biasing force of the spring. When the feeding roller 3 is further continuously rotated, the leading edge of the preceding sheet 1-A abuts against the conveyance nip portion formed by the conveyance roller 5 and the pinch roller 6. At this time, the conveyance roller 5 stops. By rotating the feeding roller 3 by a predetermined amount even after the leading edge of the preceding sheet 1-A abuts against the conveyance nip portion, alignment of the preceding sheet 1-A is performed to correct the skew while the leading edge of the preceding sheet 1-A abuts against the conveyance nip portion. The skew correction operation will also be referred to as the registration adjustment operation.

The description will be given with reference to ST13 of FIG. 6. Upon end of the skew correction operation of the preceding sheet 1-A, driving of the feeding motor 206 stops and, in preparation for printing on the back surface of the printing sheet, a state is switched to a state in which the pickup roller 2 is not rotated even if the driving shaft 19 is driven. That is, feeding of the new printing sheet 1 stops. Then, the conveyance motor 205 is driven to start rotation of the conveyance roller 5. When the conveyance roller 5 is rotated in a state in which the preceding sheet 1-A is sandwiched between both the conveyance nip portion and the feeding nip portion, the feeding roller 3 is rotated together, and the sheet is stretched between the conveyance roller 5 and the feeding roller 3.

After the preceding sheet 1-A is aligned with the position facing the printhead 7, the printing operation is performed by discharging ink from the printhead 7 based on the printing data. Note that the alignment operation is performed by making the leading edge of the printing sheet abut against the conveyance nip portion to temporarily position the printing sheet at the position of the conveyance roller 5, and then controlling the rotation amount of the conveyance roller 5 with reference to the position of the conveyance roller 5.

Figure 7:
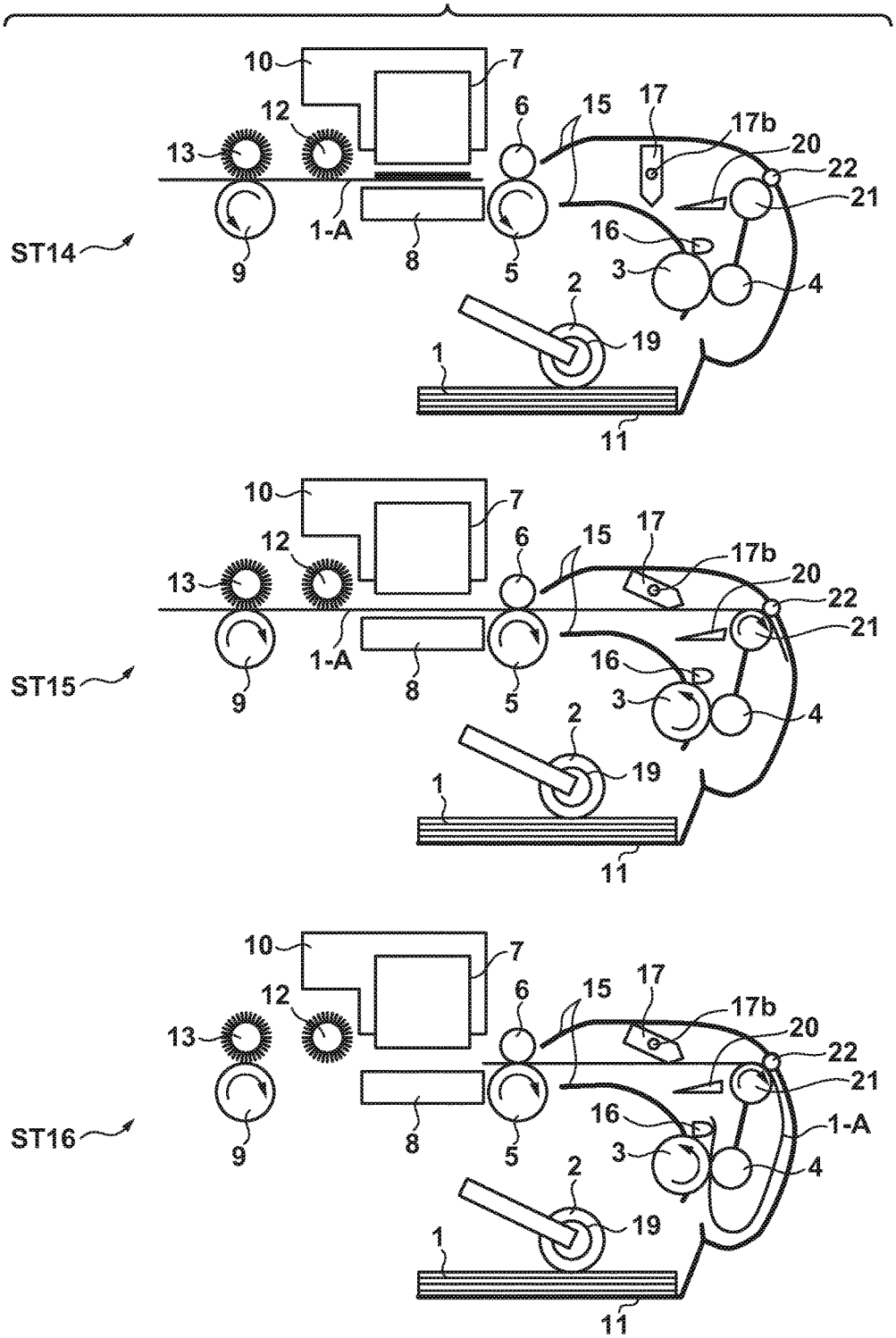
FIG. 7 shows views for explaining the feeding operation when performing the printing operation on both sides of the sheet in the printing apparatus according to the embodiment of the present invention.

The description will be given with reference to ST14 of FIG. 7. The printing apparatus of this embodiment is the serial type printing apparatus in which the carriage 10 mounts the printhead 7. The operation of printing the printing sheet is performed by repeating the conveyance operation of intermittently conveying the printing sheet by a predetermined amount using the conveyance roller 5 and the image forming operation of discharging ink from the printhead 7 while moving the carriage 10 incorporating the printhead 7 when the conveyance roller 5 stops.

The description will be given with reference to ST15 of FIG. 7. After the printing operation is complete, backward rotations of the conveyance roller 5 and the discharge roller 9 start. The trailing edge of the preceding sheet 1-A rotates the sheet pressing lever 17 about the rotating shaft 17*b* in the counterclockwise direction and moves on the flapper 20. When the conveyance roller 5 is further continuously rotated in the backward direction, the trailing edge of the preceding sheet 1-A is conveyed to the reverse feeding nip portion formed by the reverse roller 21 and the reverse driven roller 22.

Driving of the feeding motor 206 starts in accordance with the backward rotations of the conveyance roller 5 and the discharge roller 9. This rotates the feeding roller 3 and rotates the reverse roller 21 in the same direction as the backward rotation direction of the conveyance roller 5, reversely conveying the printing sheet. Even if driving of the feeding motor 206 starts, the pickup roller 2 never rotates because it is set in a non-rotating state in ST13 of FIG. 6.

The description will be given with reference to ST16 of FIG. 7. By further continuously rotating the reverse roller 21 and the feeding roller 3, the preceding sheet 1-A is conveyed to the feeding nip portion. Once the preceding sheet 1-A reaches the feeding roller 3, driving of the conveyance motor 205 stops to stop the conveyance roller 5 and the discharge roller 9. Comparing with the state of ST11 of FIG. 6 in which the preceding sheet 1-A is picked up from the feeding tray 11 at this time, the leading edge and the trailing edge of the sheet are interchanged, the front surface and the back surface are reversed at the position facing the printhead 7.

Figure 8:
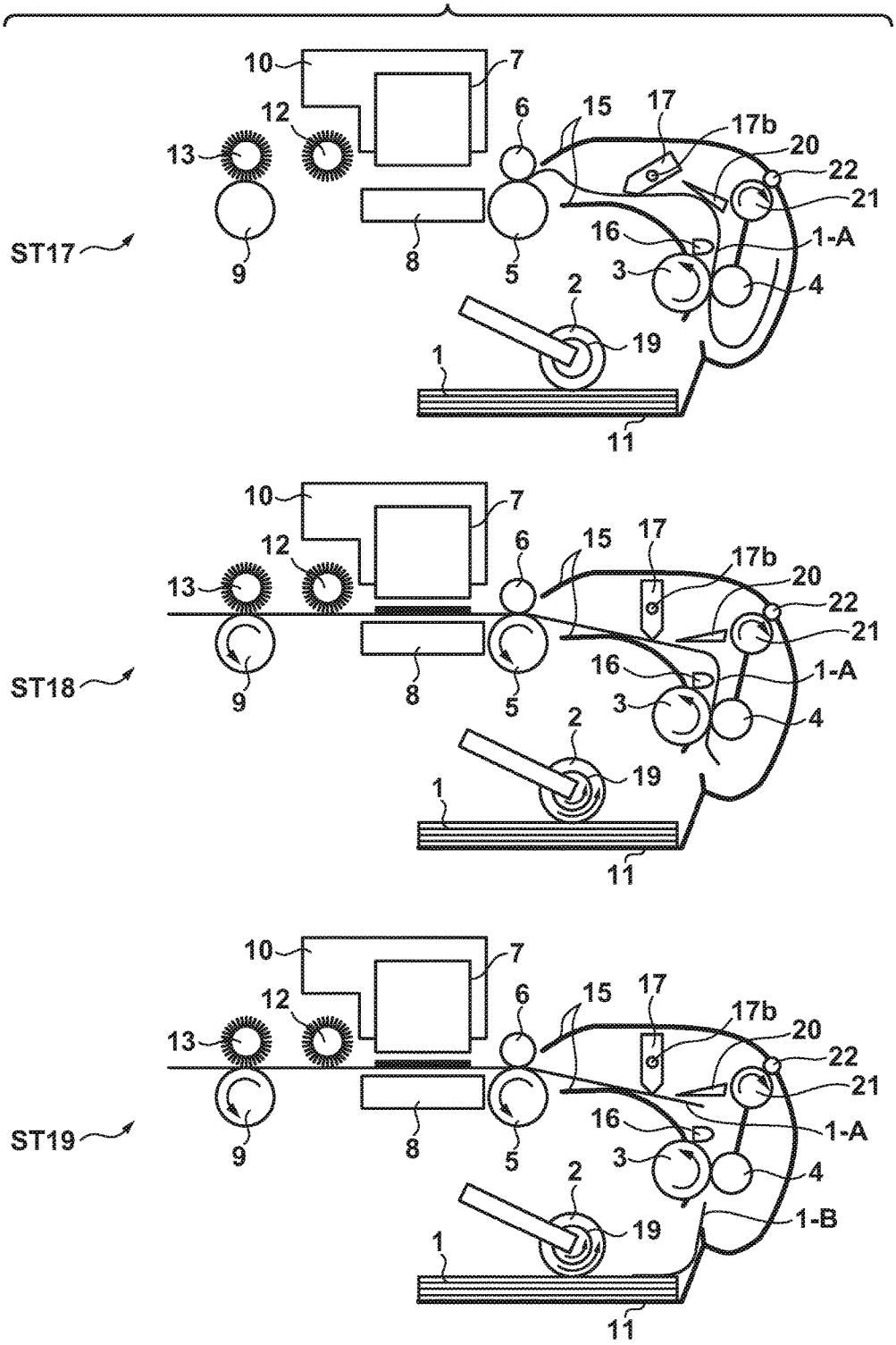
FIG. 8 shows views for explaining the feeding operation when performing the printing operation on both sides of the sheet in the printing apparatus according to the embodiment of the present invention.

The description will be given with reference to ST17 of FIG. 8. By further continuously rotating the feeding roller 3, the leading edge of the preceding sheet 1-A rotates the sheet pressing lever 17 about the rotating shaft 17*b* in the clockwise direction and moves downstream, performing the registration adjustment operation of the back surface of the preceding sheet 1-A.

The description will be given with reference to ST18 of FIG. 8. When the host computer 214 transmits printing data on the back surface, the preceding sheet 1-A is aligned with the position facing the printhead 7, and the printing operation is performed on the back surface of the preceding sheet 1-A (printing operation in progress) by discharging ink from the printhead 7 based on the printing data. In accordance with alignment of the preceding sheet 1-A, a state is switched to a state in which the pickup roller 2 rotates when the driving shaft 19 is driven.

The description will be given with reference to ST19 of FIG. 8. When the conveyance roller 5 intermittently conveys the preceding sheet 1-A by a predetermined amount in the printing operation of the back surface of the preceding sheet 1-A, the feeding motor 206 is driven to start intermittent driving of the pickup roller 2 and the feeding roller 3 once the trailing edge of the preceding sheet 1-A passes through a predetermined position. The trailing edge position of the preceding sheet 1-A is determined by the rotation amount of the conveyance roller 5 after the registration adjustment operation with reference to the position of the conveyance roller 5. Consequently, the succeeding sheet 1-B is picked up.

Intermittent driving of the pickup roller 2 and the feeding roller 3 also rotates the pickup roller 2 and the feeding roller 3 when rotating the conveyance roller 5, and also stops the pickup roller 2 and the feeding roller 3 when stopping the conveyance roller 5. The rotation speed of the feeding roller 3 is lower than that of the conveyance roller 5. Consequently, the sheet is stretched between the conveyance roller 5 and the feeding roller 3. The feeding roller 3 is rotated together with the printing sheet conveyed by the conveyance roller 5.

Figure 9:
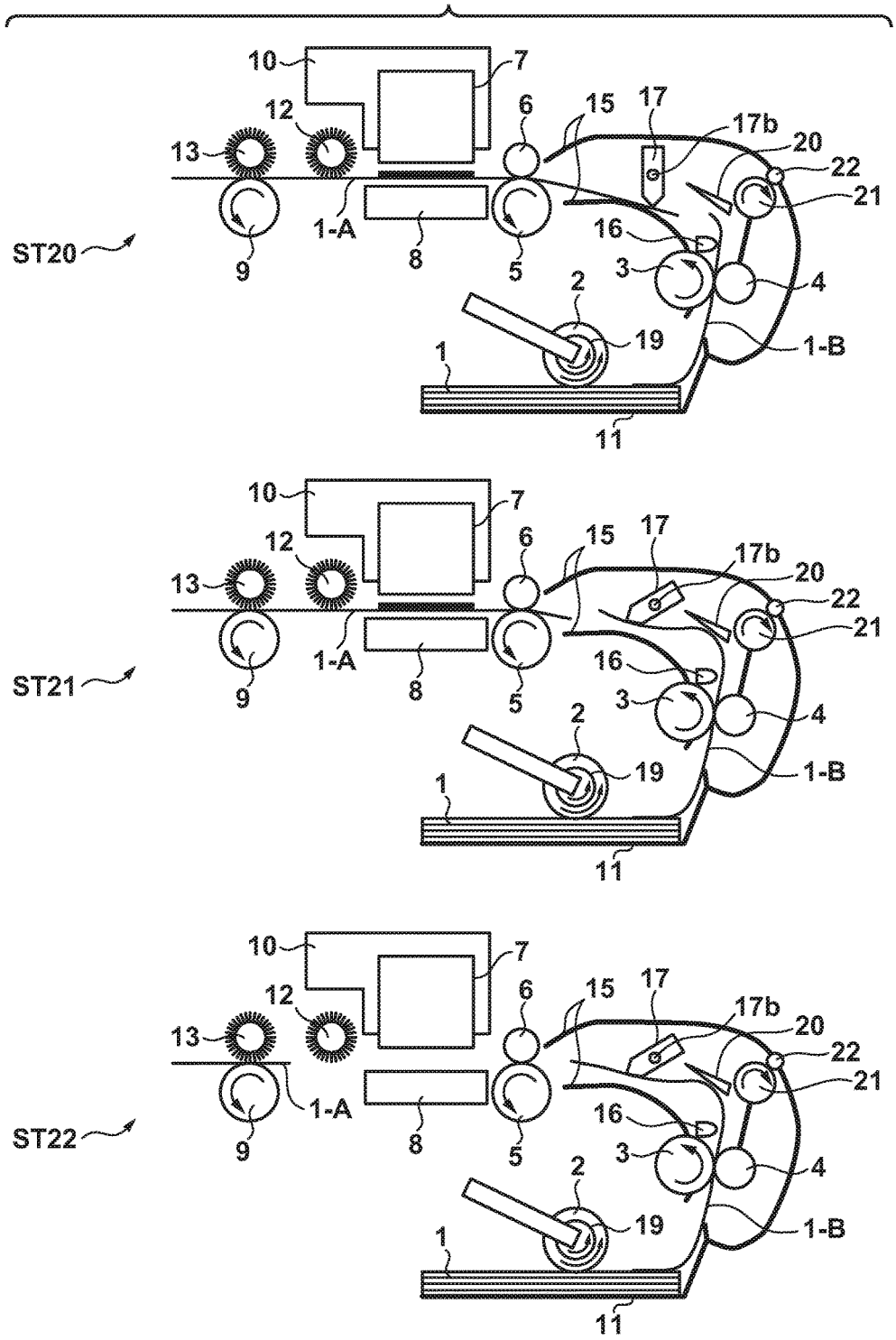
FIG. 9 shows views for explaining the feeding operation when performing the printing operation on both sides of the sheet in the printing apparatus according to the embodiment of the present invention.

The description will be given with reference to ST20 of FIG. 9. The preceding sheet 1-A undergoes the image forming operation by the printhead 7 based on the printing data. Once the trailing edge of the preceding sheet 1-A passes through the feeding nip portion by intermittent conveyance of the conveyance roller 5, intermittent driving of the pickup roller 2 and the feeding roller 3 stops to continuously rotate the pickup roller 2 and the feeding roller 3, and feed the succeeding sheet 1-B.

The description will be given with reference to ST21 of FIG. 9. The succeeding sheet 1-B follows the preceding sheet 1-A by continuously rotating the feeding roller 3, narrowing the distance between the trailing edge of the preceding sheet 1-A and the leading edge of the succeeding sheet 1-B. The succeeding sheet 1-B is fed by the feeding roller 3 until the leading edge of the succeeding sheet 1-B stops at the predetermined position upstream of the conveyance nip portion. The position of the leading edge of the succeeding sheet 1-B is calculated from the rotation amount of the feeding roller 3 after the sheet detection sensor 16 detects the leading edge of the succeeding sheet 1-B, and controlled based on the calculation result.

The description will be given with reference to ST22 of FIG. 9. The preceding sheet 1-A is discharged outside the printing apparatus by rotating the conveyance roller 5 and the discharge roller 9 after the printing operation ends. Then, driving of the conveyance motor 205 stops to stop the conveyance roller 5 and the discharge roller 9.

Figure 10:
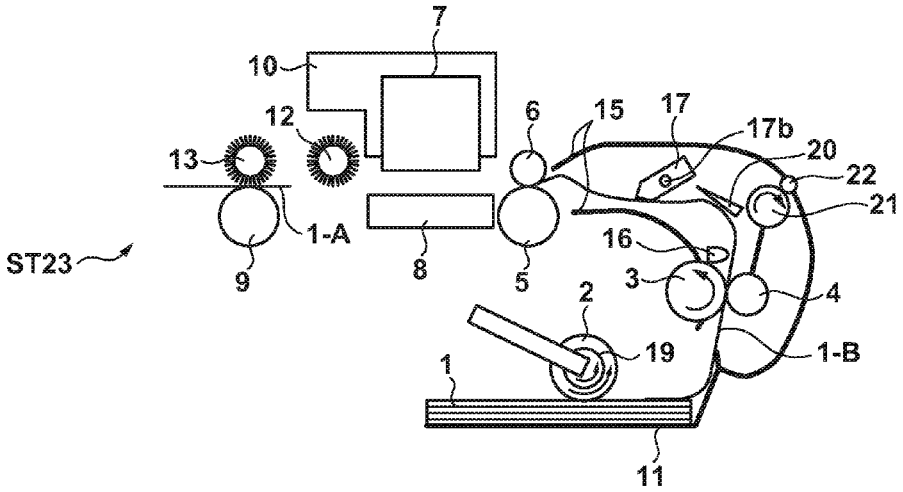
FIG. 10 is a view for explaining the feeding operation when performing the printing operation on both sides of the sheet in the printing apparatus according to the embodiment of the present invention.

The description will be given with reference to ST23 of FIG. 10. After the leading edge of the succeeding sheet 1-B is made to abut against the conveyance nip portion by driving the feeding roller 3 to perform the skew correction operation of the succeeding sheet 1-B, and the host computer 214 transmits the printing data on the front surface, the printing operation is performed by the printhead 7 based on the printing data. If there is printing data even after the printing operation for the succeeding sheet 1-B, the process returns to ST13 of FIG. 6 to repeat a series of feeding operations.

FIGS. 11A to 11D are flowcharts illustrating the feeding operation of the printing sheet when printing on both sides of the printing sheet according to this embodiment. In step S101 of FIG. 11A, when the host computer 214 transmits information on printing on both sides of the printing sheet, the MPU 201 starts controlling this flowchart.

In step S102, the feeding operation of the preceding sheet 1-A starts. More specifically, the MPU 201 drives the feeding motor 206 at low speed via the feeding motor driver 210. In low-speed driving, the pickup roller 2 and the feeding roller 3 rotate at 7.6 inches/sec. The pickup roller 2 picks up the preceding sheet 1-A from the feeding tray 11. The feeding roller 3 feeds the front surface of the preceding sheet 1-A toward the printhead 7.

In step S103, the sheet detection sensor 16 detects the leading edge of the preceding sheet 1-A. When the sheet detection sensor 16 detects the leading edge of the preceding sheet 1-A, the MPU 201 switches the feeding motor 206 to high-speed driving via the feeding motor driver in step S104. In high-speed driving, the pickup roller 2 and the feeding roller 3 rotate at 20 inches/sec. By controlling the rotation amount of the feeding motor 206 after the sheet detection sensor 16 detects the leading edge of the preceding sheet 1-A, the skew correction operation of the preceding sheet 1-A is performed in step S105.

When the host computer 214 transmits the printing data on the front surface, alignment of the preceding sheet 1-A is performed based on the printing data on the front surface in step S106. The MPU 201 controls the rotation amount of the conveyance motor 205 via the conveyance motor driver 209. The conveyance roller 5 rotates at 15 inches/sec. Then, based on the printing data, the preceding sheet 1-A is conveyed to a printing start position with reference to the position of the conveyance roller 5.

In step S107, a printing operation of the front surface of the preceding sheet 1-A starts when the printhead 7 discharges ink. More specifically, a conveyance operation of intermittently conveying the preceding sheet 1-A by the conveyance roller 5 by controlling the rotation amount of the conveyance motor 205 and an operation of moving the carriage 10 by controlling the rotation amount of the carriage motor 204 via the carriage motor driver are performed. Further, based on the printing data loaded into the RAM 203, the printing operation of the preceding sheet 1-A is performed by repeating an image forming operation (ink discharge operation) of discharging ink from the printhead 7 via the printhead driver.

The process stands by for completion of the printing operation of the front surface of the preceding sheet 1-A in step S108. Upon completion of the printing operation, a reverse feeding operation of the preceding sheet 1-A starts in step S109. The conveyance motor 205 and the feeding motor 206 are driven in the backward direction at low speed. The conveyance roller 5 and the reverse roller 21 reversely rotate at 7.6 inches/sec. The conveyance motor 205 rotates the conveyance roller 5 in a direction opposite to that of intermittent conveyance in the printing operation to convey the preceding sheet 1-A, thereby reversing the preceding sheet 1-A.

After the preceding sheet 1-A reaches the feeding roller 3 via the reverse roller 21, and the sheet detection sensor 16 detects the leading edge of the preceding sheet 1-A, the skew correction operation of the preceding sheet 1-A is performed in step S110 by controlling the rotation amount of the feeding motor 206. The rotation amount of the conveyance motor 205 is controlled when the host computer 214 transmits the printing data on the back surface in step S111. The conveyance roller 5 rotates at 15.0 inches/sec to perform alignment of the back surface of the preceding sheet 1-A. In step S112, the printing operation of the back surface of the preceding sheet 1-A starts.

Figure 11A:
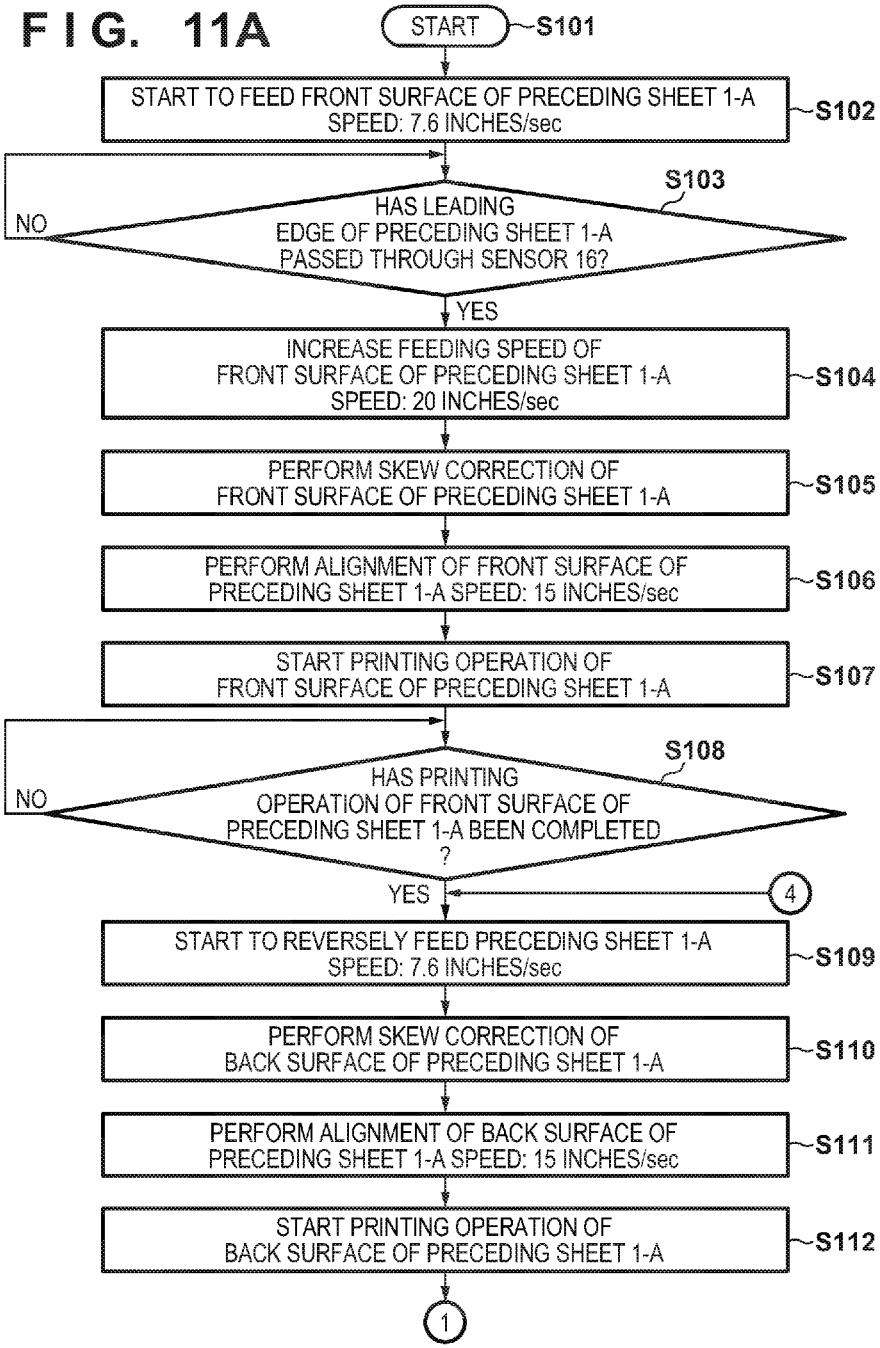
FIG. 11A is a flowchart illustrating the feeding operation when performing the printing operation on both sides of the sheet according to the embodiment.
Figure 11B:
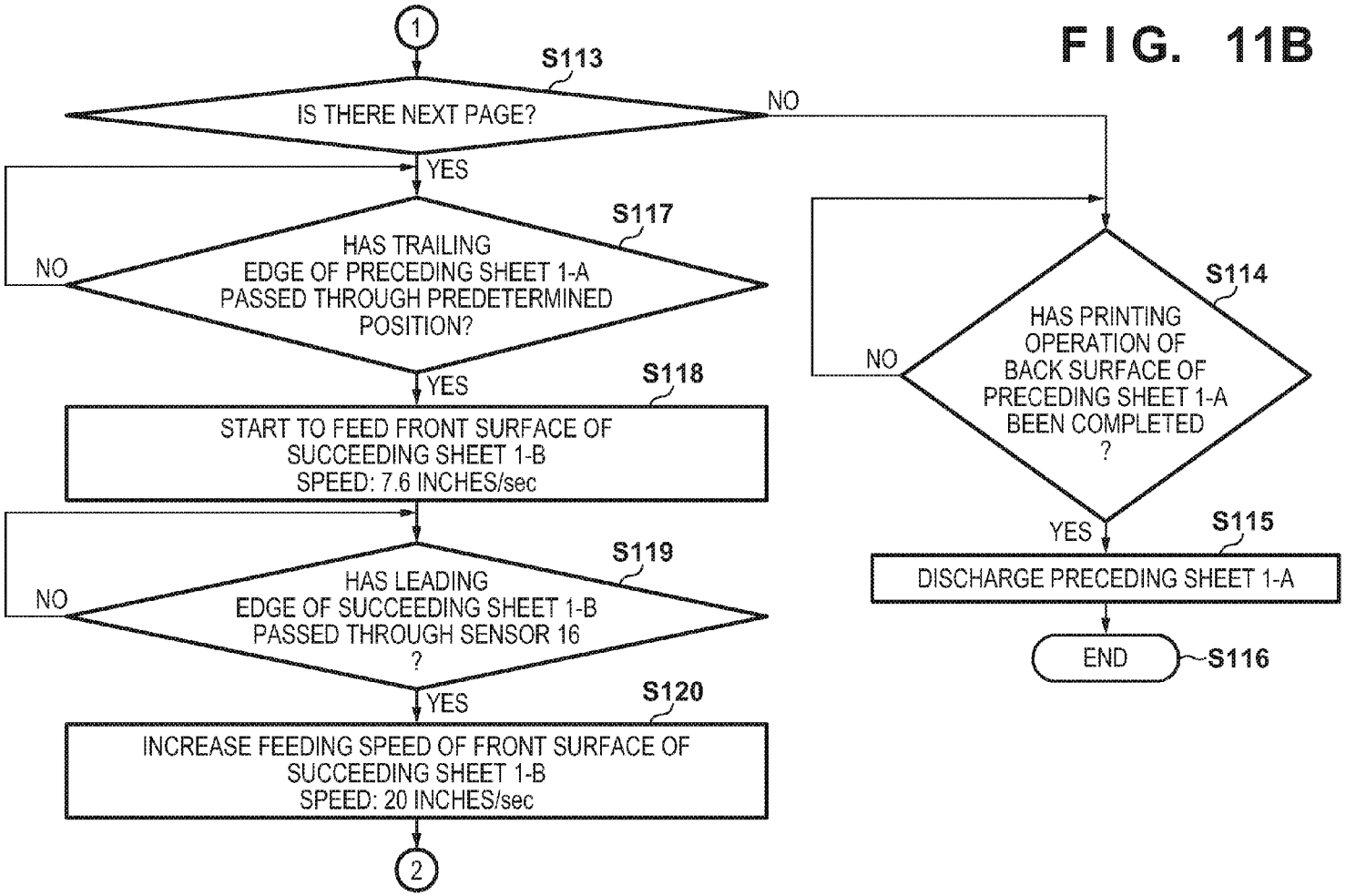
FIG. 11B is a flowchart illustrating the feeding operation when performing the printing operation on both sides of the sheet according to the embodiment.
Figure 11C:
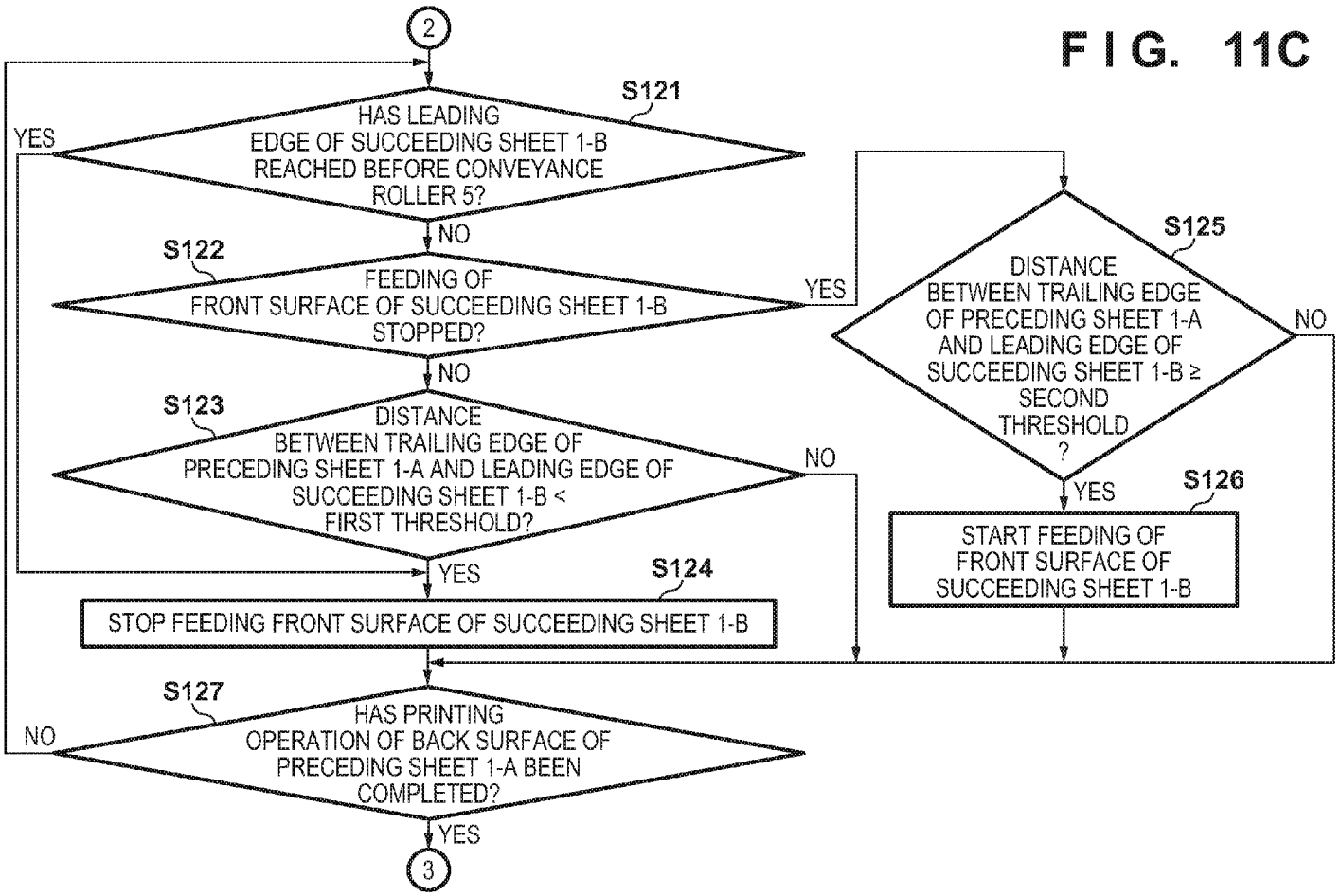
FIG. 11C is a flowchart illustrating the feeding operation when performing the printing operation on both sides of the sheet according to the embodiment.

In step S113 of FIG. 11B, it is determined whether there is printing data on the front surface of the next page. The host computer 214 transmits information on whether there is the printing data on the front surface of the next page. If there is no printing data on the front surface of the next page, the process advances to step S114. The process stands by for completion of the printing operation of the back surface of the preceding sheet 1-A in step S114. Upon completion of the printing operation, the preceding sheet 1-A is discharged in step S115, and this flowchart ends in step S116.

If there is the printing data on the front surface of the next page in step S113, it is determined, in step S117, whether the trailing edge of the preceding sheet 1-A passes through the predetermined position. The trailing edge position of the preceding sheet 1-A is calculated by adding the size of the printing sheet from the leading edge position. The leading edge position is defined by the distance from the conveyance nip portion and calculated by the rotation amount of the conveyance motor 205 after the skew correction operation.

Once the trailing edge of the preceding sheet 1-A passes through the predetermined position, the feeding operation of the succeeding sheet 1-B starts in step S118. The pickup roller 2 picks up the succeeding sheet 1-B, and the feeding roller 3 feeds the succeeding sheet 1-B toward the printhead 7. The feeding motor 206 is driven at low speed. The pickup roller 2 and the feeding roller 3 rotate at 7.6 inches/sec. The succeeding sheet 1-B is fed while having a predetermined distance with respect to the trailing edge of the preceding sheet 1-A.

In step S119, the sheet detection sensor 16 detects the leading edge of the succeeding sheet 1-B. When the sheet detection sensor 16 detects the leading edge of the succeeding sheet 1-B, the feeding motor 206 is switched to high-speed driving in step S120. That is, the pickup roller 2 and the feeding roller 3 rotate at 20 inches/sec.

The leading edge position of the succeeding sheet is controlled by using the rotation amount of the feeding motor 206 after the sheet detection sensor 16 detects the leading edge of the succeeding sheet 1-B. In step S121 of FIG. 11C, it is determined whether the leading edge of the succeeding sheet 1-B has reached a position a predetermined amount before the conveyance nip portion. If the leading edge has reached that position, driving of the feeding motor 206 stops to stop feeding the succeeding sheet 1-B in step S124, and the process stands by for completion of the printing operation of the back surface of the preceding sheet 1-A in step S127.

If the leading edge of the succeeding sheet 1-B has not reached the position the predetermined amount before the conveyance nip portion in step S121, a feeding state of the succeeding sheet 1-B is checked in step S122. If the succeeding sheet 1-B is fed, in step S123, the distance between the trailing edge position of the preceding sheet 1-A and the leading edge position of the succeeding sheet 1-B is calculated to determine whether that distance is smaller than the first threshold. If the distance is smaller than the first threshold, feeding of the succeeding sheet 1-B stops in step S124. If the distance is equal to or larger than the first threshold, the feeding continues.

If feeding of the succeeding sheet 1-B stops in step S122, the distance between the trailing edge position of the preceding sheet 1-A and the leading edge position of the succeeding sheet 1-B is calculated to determine whether that distance is equal to or larger than the second threshold in step S125. If the distance is equal to or larger than the second threshold, feeding of the succeeding sheet 1-B resumes in step S126. If the distance is smaller than the second threshold, a stop state continues. The first threshold and the second threshold may be the same or different in value.

It is determined in step S127 whether the printing operation of the back surface of the preceding sheet 1-A is complete. If the printing operation is not complete, the process returns to step S121 described above to repeat the process up to step S126 described above. If the printing operation is complete, the process advances to step S128 of FIG. 11D.

Figure 11D:
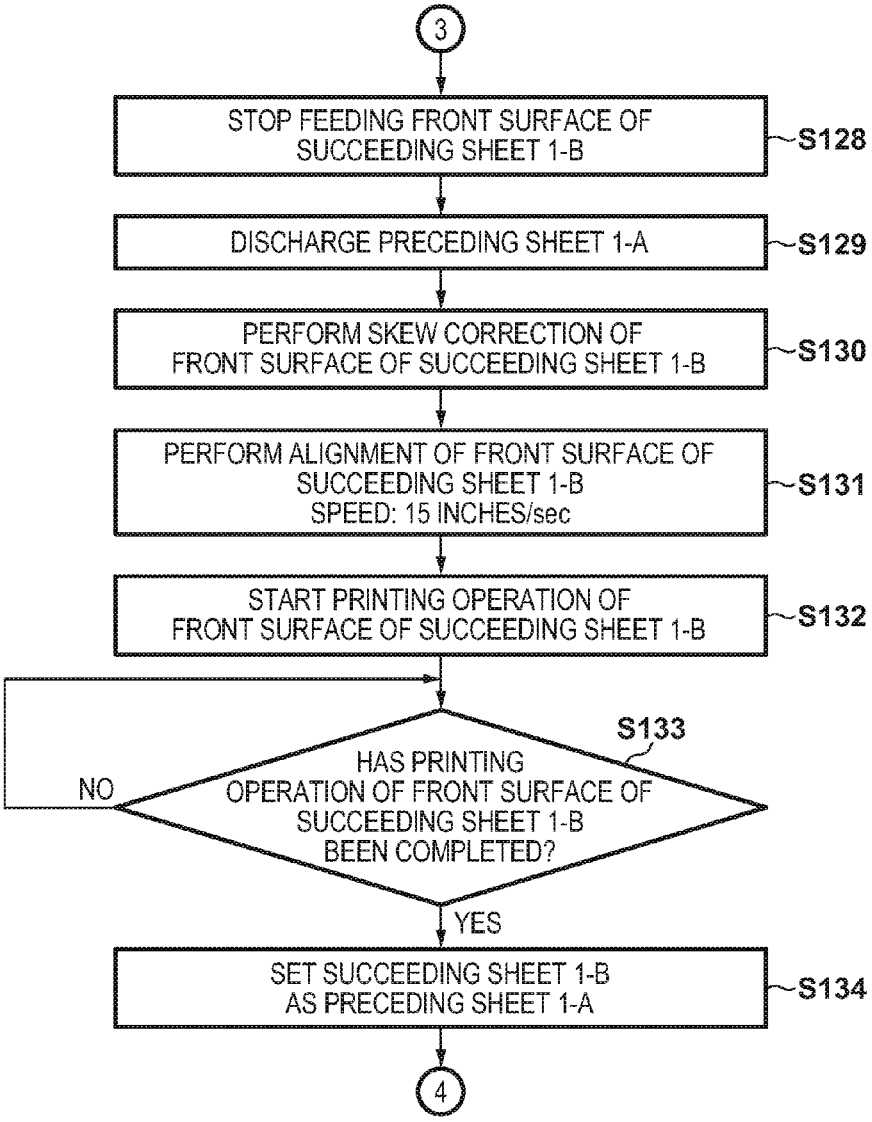
FIG. 11D is a flowchart illustrating the feeding operation when performing the printing operation on both sides of the sheet according to the embodiment.

In FIG. 11D, feeding of the succeeding sheet 1-B stops in step S128, and the conveyance motor 205 is driven to discharge the preceding sheet 1-A in step S129. After the preceding sheet 1-A is discharged, driving of the conveyance motor 205 stops, the feeding motor 206 is driven while the conveyance roller stops, and the skew correction operation of the succeeding sheet 1-B is performed in step S130.

When the host computer 214 transmits the printing data on the front surface of the next page, alignment of the succeeding sheet 1-B is performed based on the printing data in step S131, and the printing operation of the front surface of the succeeding sheet 1-B starts in step S132.

In step S133, the process stands by for completion of the printing operation of the front surface of the succeeding sheet 1-B. In step S134, the succeeding sheet 1-B is set as the preceding sheet 1-A. Then, the process returns to step S109, and the printing operation is performed on both sides of the plurality of printing sheets by repeating the aforementioned control thereafter.

As described above, according to the above embodiment, it is possible to start to feed the succeeding sheet even if the marginal amount of the trailing edge of the preceding sheet 1-A and that of the leading edge of the succeeding sheet 1-B are not confirmed.

When performing the printing operation of the back surface of the preceding sheet 1-A by the printhead 7, the feeding motor 206 is driven in synchronization with the conveyance motor 205 before the sheet detection sensor 16 detects the leading edge of the succeeding sheet 1-B, and the feeding motor 206 rotates based on the distance between the trailing edge position of the preceding sheet 1-A and the leading edge position of the succeeding sheet 1-B after the sheet detection sensor 16 detects the leading edge of the succeeding sheet. This makes it possible to narrow the distance between the trailing edge of the preceding sheet 1-A and the leading edge of the succeeding sheet 1-B, and also to maintain that distance at an almost constant distance.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-177920, filed Sep. 9, 2015, which is hereby incorporated by reference herein in its entirety.

What is claimed is:

1. A printing apparatus comprising:

a feeding roller configured to feed a sheet;

a conveyance roller configured to convey the sheet fed by the feeding roller;

an inkjet printing head configured to print on the sheet conveyed by the conveyance roller;

a reversing path for reversing the sheet from a first surface to a second surface; and a control unit configured to control feeding of a preceding sheet and a succeeding sheet fed next to the preceding sheet, wherein the control unit starts feeding of the succeeding sheet when a trailing edge of the preceding sheet, which was reversed by the reversing path, reaches a predetermined position and feeds the succeeding sheet so that a distance between the trailing edge of the preceding sheet and a leading edge of the succeeding sheet is within a predetermined range.

2. The apparatus according to claim 1, wherein the control unit does not feed the succeeding sheet when the inkjet printing head prints on the first surface of the preceding sheet.

3. The apparatus according to claim 1, wherein, when printing on only the first surface of the preceding sheet, the control unit starts feeding of the succeeding sheet before printing on the first surface of the preceding sheet is completed.

4. The apparatus according to claim 1, wherein when feeding the succeeding sheet, the control unit starts feeding of the succeeding sheet while having a predetermined distance between the trailing edge of the preceding sheet and the leading edge of the succeeding sheet.

5. The apparatus according to claim 4, wherein the control unit shortens the distance between the trailing edge of the preceding sheet and the leading edge of the succeeding sheet by rotating the feeding roller, which feeds the succeeding sheet, at a rotation speed higher than that of the conveyance roller while the preceding sheet is conveyed by the conveyance roller.

6. The apparatus according to claim 1, wherein, when feeding the succeeding sheet, the control unit stops feeding of the succeeding sheet if the distance between the trailing edge of the preceding sheet and the leading edge of the succeeding sheet is shorter than a first threshold, and starts feeding of the succeeding sheet if the distance is longer than a second threshold that is longer than the first threshold.

7. A control method of controlling a printing apparatus that includes a feeding roller configured to feed a sheet, a conveyance roller configured to convey the sheet fed by the feeding roller, an inkjet printing head configured to print on the sheet conveyed by the conveyance roller, and a reversing path for reversing the sheet from a first surface to a second surface, the method comprising:

controlling feeding of a preceding sheet and a succeeding sheet fed next to the preceding sheet by feeding the succeeding sheet when a trailing edge of the preceding sheet, which was reversed by the reversing path, reaches a predetermined position and feeding the succeeding sheet so that a distance between a trailing edge of the preceding sheet and a leading edge of the succeeding sheet is within a predetermined range.

8. A non-transitory computer readable storage medium that stores a program for causing a computer to execute steps of a control method of controlling a printing apparatus that includes a feeding roller configured to feed a sheet, a conveyance roller configured to convey the sheet fed by the feeding roller, an inkjet printing head configured to print the sheet conveyed by the conveyance roller, and a reversing path for reversing the sheet from a first surface to a second surface, the method comprising:

controlling feeding of a preceding sheet and a succeeding sheet fed next to the preceding sheet by feeding of the succeeding sheet when a trailing edge of the preceding sheet, which was reversed by the reversing path, reaches a predetermined position and feeding the succeeding sheet so that a distance between a trailing edge of the preceding sheet and a leading edge of the succeeding sheet is within a predetermined range.

9. A printing apparatus comprising:

a feeding roller configured to feed a sheet;

a conveyance roller configured to convey the sheet fed by the feeding roller;

a printing unit configured to print on the sheet conveyed by the conveyance roller;

a reversing path for reversing the sheet from a first surface to a second surface; and a control unit configured to control feeding of a preceding sheet and a succeeding sheet fed next to the preceding sheet, wherein, when feeding the succeeding sheet, the control unit stops feeding of the succeeding sheet if a distance between a trailing edge of the preceding sheet, reversed by the reversing path, and a leading edge of the succeeding sheet is shorter than a first threshold, and starts feeding of the succeeding sheet if the distance is longer than a second threshold that is longer than the first threshold.

10. The apparatus according to claim 9, wherein the control unit does not feed the succeeding sheet when the printing unit prints on the first surface of the preceding sheet.

11. The apparatus according to claim 9, wherein, when printing on only the first surface of the preceding sheet, the control unit starts feeding of the succeeding sheet before printing on the first surface of the preceding sheet is completed.

12. The apparatus according to claim 9, wherein the control unit starts feeding of the succeeding sheet when the trailing edge of the preceding sheet reaches a predetermined position.

13. The apparatus according to claim 9, wherein, when feeding the succeeding sheet, the control unit starts feeding of the succeeding sheet while having a predetermined distance between the trailing edge of the preceding sheet and the leading edge of the succeeding sheet.

14. The apparatus according to claim 13, wherein the control unit shortens the distance between the trailing edge of the preceding sheet and the leading edge of the succeeding sheet by rotating the feeding roller, which feeds the succeeding sheet, at a rotation speed higher than that of the conveyance roller while the preceding sheet is conveyed by the conveyance roller.

* * * * *